US007111378B2

(12) United States Patent
Aldana

(10) Patent No.: US 7,111,378 B2
(45) Date of Patent: Sep. 26, 2006

(54) FASTENER CLOSING

(75) Inventor: Francisc Javier Ramirez Aldana, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 492 days.

(21) Appl. No.: 10/644,300

(22) Filed: Aug. 20, 2003

(65) Prior Publication Data

US 2005/0042060 A1 Feb. 24, 2005

(51) Int. Cl.
*B21J 15/02* (2006.01)
*B25C 7/00* (2006.01)

(52) U.S. Cl. ..... 29/525.05; 227/155; 227/153; 227/140; 29/788; 29/818; 29/243.58; 270/58.08; 412/34

(58) Field of Classification Search ..... 29/525.01, 29/525.05, 243.57, 243.58, 243.56, 513, 29/788, 818; 227/19, 87, 88, 89, 111, 134, 227/140, 153, 154, 155, 156; 270/52.18, 270/58.08, 58.11, 58.13; 412/33, 34
See application file for complete search history.

(56) References Cited

U.S. PATENT DOCUMENTS

| | | | | | |
|---|---|---|---|---|---|
| 1,851,621 | A | * | 3/1932 | Ede | 227/88 |
| 2,748,388 | A | * | 6/1956 | Cardani | 227/88 |
| 2,755,471 | A | * | 7/1956 | Wittknhns et al. | 227/64 |
| 4,194,666 | A | * | 3/1980 | Spehrley et al. | 227/155 |
| 4,328,919 | A | | 5/1982 | Lawrence et al. | |
| 4,344,554 | A | | 8/1982 | Cross | |
| 4,557,410 | A | | 12/1985 | Holden et al. | |
| 4,593,847 | A | * | 6/1986 | Hagemann | 227/155 |
| 5,076,483 | A | | 12/1991 | Olesen | |
| 5,141,143 | A | | 8/1992 | Ebner et al. | |
| 5,413,266 | A | | 5/1995 | Jairam | |
| 5,460,314 | A | | 10/1995 | Udagawa | |
| 5,516,025 | A | * | 5/1996 | Eriksson | 227/155 |
| 5,586,710 | A | * | 12/1996 | Golicz | 227/155 |
| 5,662,318 | A | * | 9/1997 | Harada et al. | 270/58.05 |
| 5,782,467 | A | | 7/1998 | Johnson | |
| 5,818,186 | A | | 10/1998 | Camino | |
| 5,862,971 | A | * | 1/1999 | Ebner | 227/155 |
| H1842 | H | | 3/2000 | Tontarski | |
| 6,036,074 | A | * | 3/2000 | Manabe | 227/155 |
| 6,056,183 | A | * | 5/2000 | Tanabe | 227/155 |
| 6,099,225 | A | | 8/2000 | Allen et al. | |
| 6,164,513 | A | * | 12/2000 | Yoshie | 227/155 |
| 6,474,388 | B1 | | 11/2002 | Boss | |
| 6,485,606 | B1 | | 11/2002 | Boss | |
| 6,550,756 | B1 | | 4/2003 | Trovinger | |
| 6,554,267 | B1 | | 4/2003 | Trovinger | |
| 6,702,172 | B1 | * | 3/2004 | Håkansson | 227/155 |
| 2001/0026361 | A1 | | 10/2001 | Yamaguchi | |
| 2002/0140153 | A1 | | 10/2002 | Trovinger et al. | |
| 2005/0039319 | A1 | * | 2/2005 | Aldana et al. | 29/513 |

* cited by examiner

*Primary Examiner*—Essama Omgba

(57) ABSTRACT

Apparatus for closing a fastener includes a first member adapted to engage and bend a fastener toward a closed position, a second member defining a recessed fastener guide adapted to engage and bend the fastener toward the closed position, the recessed fastener guide being generally aligned with the first member to receive at least a portion of the fastener from the first member, structure for moving the first member, and structure for moving the second member relative to the first member to move the fastener toward the closed position.

16 Claims, 7 Drawing Sheets

FASTENER CLOSING

BACKGROUND OF THE INVENTION

Electronic publishing, desktop publishing and other tasks involving print media or other media demand more than a stack of paper in an output tray of a laser printer or photocopier. Typically, many sheets must be bound into finished documents by a paper-handling accessory. Currently, machines exist to perform operations such as binding, folding, trimming, saddle stapling, and hole drilling. These finishing operations are typically performed on many sheets at a time, requiring high forces and powerful motors. Such machines are often expensive and large, depending on function, and often exceed the cost or footprint of desktop or office printers. As such, they are not well-suited to low-cost desktop finishing or other low-cost applications, for example.

The demands of e.g. electronic and desktop publishing are driving the need for more compact, low-cost, high-quality, and high-speed finishing machines suitable for use alone or with printers, photocopiers, and other machines. Prior-art solutions to making booklets, for example, have involved machines costing thousands of dollars for simple functions such as folding and stapling. They are often bulky, slow, and expensive. Current finishing techniques impose size, cost and power limits upon booklet-making devices and other fastening devices, and hinder the use of these devices in many applications.

SUMMARY OF THE INVENTION

Apparatus for closing a fastener includes a first member adapted to engage and bend a fastener toward a closed position, a second member defining a recessed fastener guide adapted to engage and bend the fastener toward the closed position, the recessed fastener guide being generally aligned with the first member to receive at least a portion of the fastener from the first member, structure for moving the first member, and structure for moving the second member relative to the first member to move the fastener toward the closed position.

DETAILED DESCRIPTION

Figure 1:
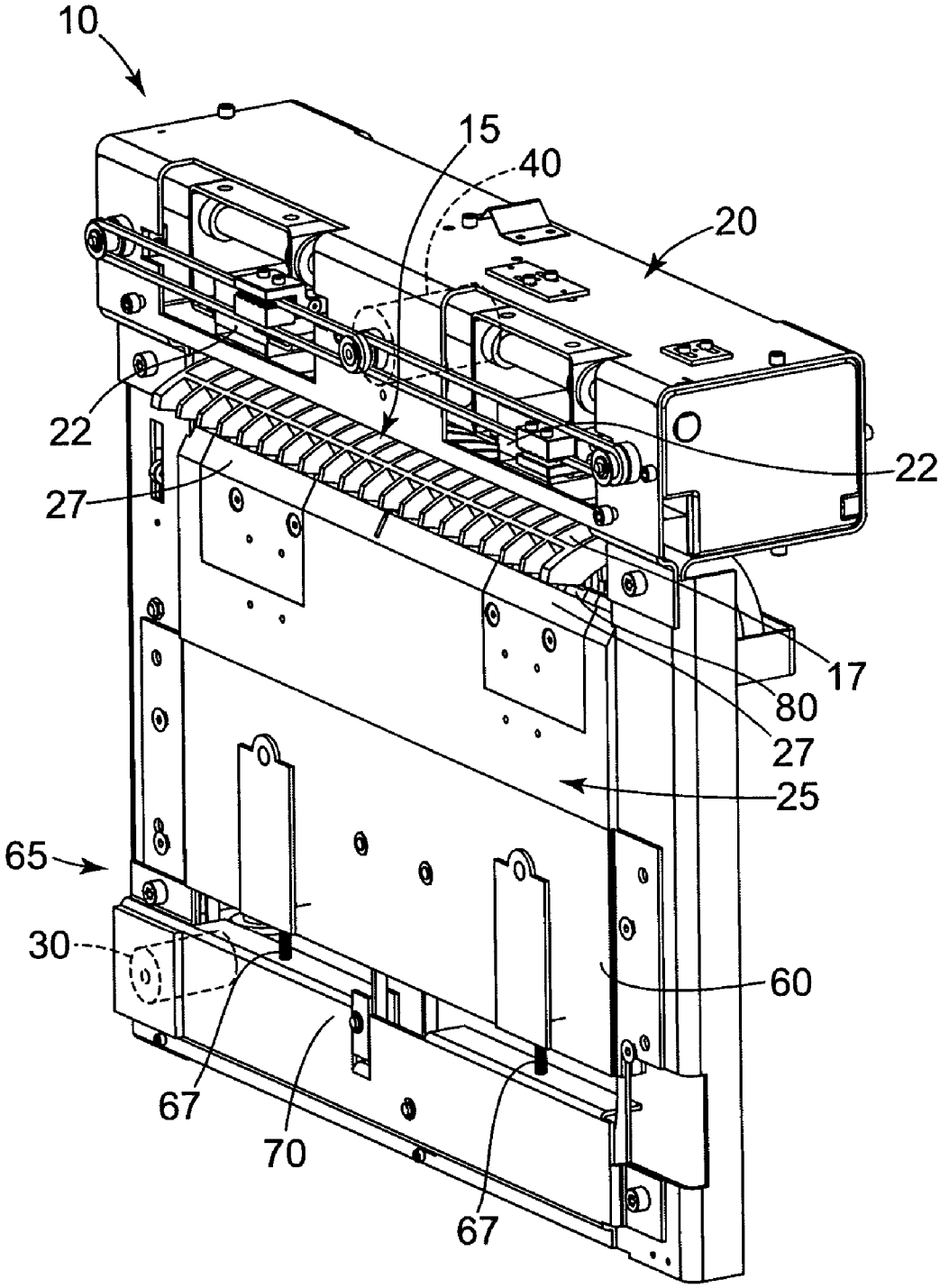
FIG. 1 is a perspective view of a fastening device, according to an embodiment of the invention.

FIG. 1 shows fastening device 10 for sheet media or other media according to an embodiment of the invention. Fastening device 10 includes media transporter assembly 15, including transporter or guide 17, for guiding, moving, or otherwise transporting media with respect to fastening device 10. Fastener head assembly 20 of fastening device 10 includes two fastener heads 22, each for discharging one or more fasteners, such as staples, into sheet media or other media transported by transporter 17. More specifically, fastener heads 22 each include a spring-loaded staple cartridge, for example, for automatically discharging one or more staples upon contact of sufficient force between fastener heads 22 and the media to be fastened. Closing assembly 25 of fastening device 10 supports the media during staple discharge, and includes two closing mechanisms 27 for closing the staples or other fasteners once they are discharged.

Each fastener head 22 of fastener head assembly is one of a plurality of fastener heads together adapted to simultaneously discharge a plurality of fasteners into sheet media or other media transported by transporter 17. Alternatively, fastening device 10 includes just one fastener head 22. Each closing mechanism 27 of closing assembly 25 is one of a plurality of closing mechanisms adapted to simultaneously close the plurality of fasteners. Alternatively, fastening device 10 includes just one closing mechanism. Each closing mechanism is adapted to close one or more fasteners that are discharged in one or more different locations relative to the media.

Fastening device 10 includes motor 30 for actuating both transporter 17 and closing mechanisms 27. More specifically, motor 30 is connected to drive belts, linkages, or other connections for simultaneously actuating transporter 17 and closing mechanisms 27. Fastening device 10 also includes motor 40 for moving the plurality of fastener heads 22 to the different desired locations relative to the media. Motors 30 and 40 are DC brush motors, according to one embodiment, although other motor types are contemplated.

Fastening device 10 also includes support body 60, for supporting closing assembly 25 and the plurality of closing mechanisms 27. Support body 60 is biased toward fastener heads 22 by compliant biasing device 65. Biasing device 65 comprises one or more compression springs 67, according to one example. Compression springs 67 are connected to frame 70 and are adapted to provide compliance between frame 70 and closing assembly 25 via support body 60, to accommodate both large-thickness or small-thickness media, or stacks of media, being fastened by fastening device 10. Biasing device 65 generally minimizes jamming of media in fastening device 10. More specifically, for a booklet of 1.6 mm thickness, for example, compression springs 67 compress to accommodate that thickness. For a booklet of just 0.5 mm, for example, springs 67 do not compress as much but still apply appropriate pressure to hold the media within fastening device 10 without adverse slippage or other undesired movement. Additionally, springs 67 absorb the impact force generated when fastener heads 22 discharge fasteners into the media.

Frame 70 generally surrounds support body 60. Frame 70 also supports transporter assembly 15, fastener head assembly 20, and closing assembly 25. According to one embodiment, frame 70 is a single-piece sheet-metal frame designed to handle greater than 22 kg of stress without deformation. Other materials and constructions of frame 70 also are contemplated.

Figure 2:
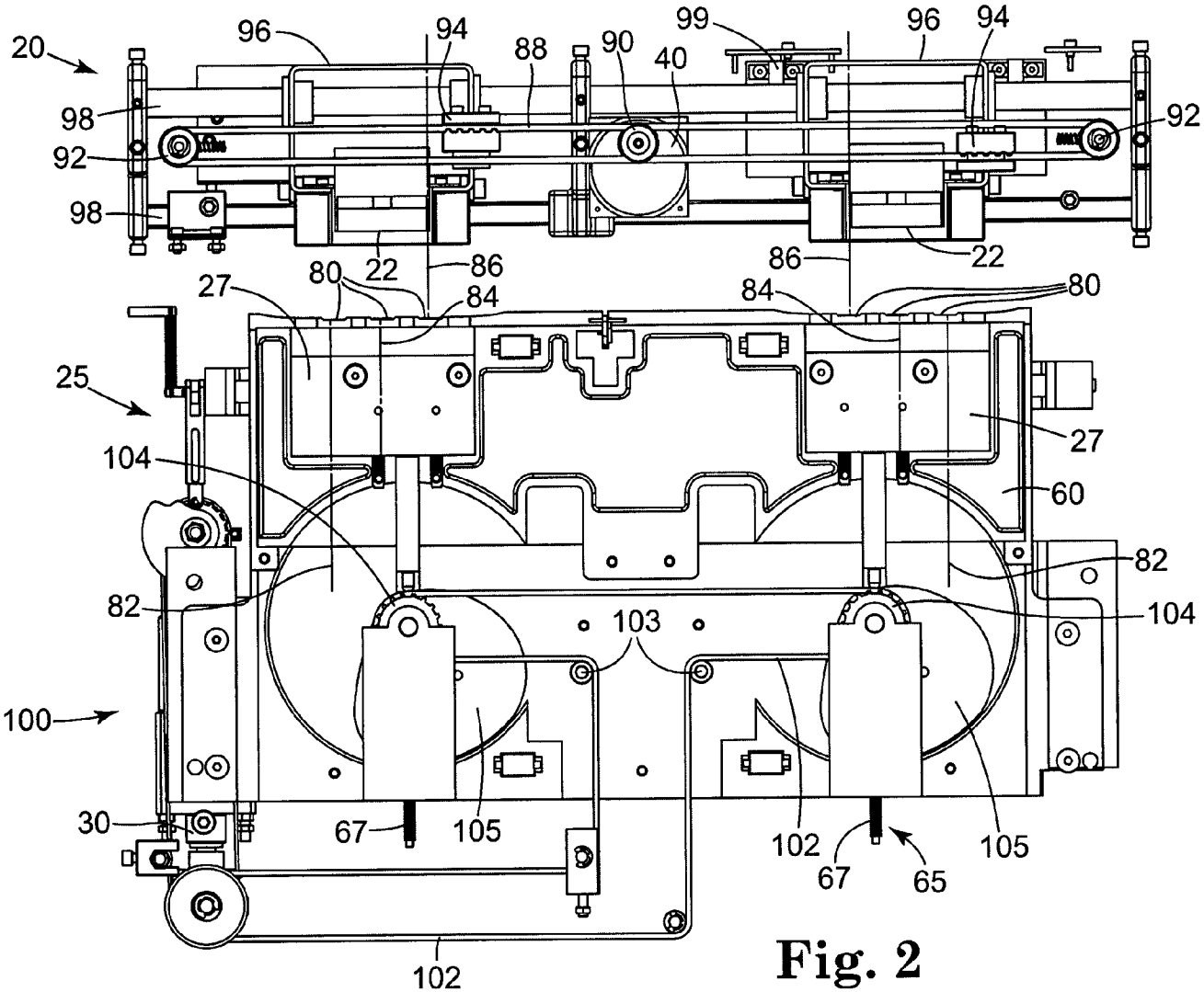
FIG. 2 is a side view of a portion of the FIG. 1 device, according to an embodiment of the invention.

As shown in FIG. 2, in which transporter 17 is omitted for clarity, each closing mechanism 27 includes three clinches 80. The three clinches 80 are generally aligned with three different positions to which fastener heads 22 are movable. Each fastener head 22 is adapted for movement to an initialization position indicated by lines 82, for example, which is also called a home position. Each fastener head 22 also is adapted for movement to a first fastener-discharge position, indicated by lines 84, and a second fastener-discharge position, indicated by lines 86. Closing mechanisms 27 are disposed to close fasteners discharged in both first fastener-discharge position 84 and second fastener-discharge position 86, and also are disposed to align with initialization position 82. According to embodiments of the invention, initialization position 82 is for staple initializing, waste accumulation, fastener head servicing or replacement, and/or repair of staple jams or other problems; i.e. it is a service position. First fastener-discharge position 84 is for media having a relatively larger fastening dimension, e.g. for an A3-size, 11-inch, or other large-spine booklet. Second fastener-discharge position 86 is for media having a relatively smaller fastening dimension, e.g. for an A5-size, 8.5×11-inch, or other small-spine booklet. According to one embodiment, fasteners are discharged either at positions 84 or 86 in the same booklet or other fastened media, but also optionally are discharged at both positions 84, 86 in the same booklet or other fastened media.

According to one embodiment, each clinch 80 aligned with service position 82 is a non-active clinch that defines a service station for fastener heads 22, and the remaining clinches 80, aligned with positions 84, 86, are active clinches. Each closing mechanism 27 optionally includes a single clinch, a pair of clinches, three clinches, or more than three clinches. In the case where the fasteners are staples, clinches 80 are staple clinches. Clinches 80 are each adapted for operable engagement with a corresponding fastener head or dispenser 22. The plurality of fastener clinches 80 are adapted to generally simultaneously close a plurality of fasteners, for example two fasteners, discharged by fastener heads or dispensers 22.

As also shown in FIG. 2, motor 40 drives belt 88 via drive wheel 90 and idler wheels 92. Belt 88 is attached to clamping blocks 94, which are rigidly attached to fastener mounts 96. Fastener mounts 96 support fastener heads 22. One clamping block 94 is mounted to an upper pass of belt 88, and the other clamping block 94 is mounted to a lower pass of belt 88, such that movement of belt 88 drives fastener heads 22 in opposite directions, either towards each other or away from each other in a direction generally parallel to the groups of clinches 80 in closing mechanisms 27. Fastener mounts 96 are supported on and slide along rails 98 to and between positions 82, 84 and 86. Optical sensor 99 is mounted to detect the position of one or more fastener heads 22 as they travel on rails 98.

Actuation mechanism 100 is supported by support body 60 and moves fastener clinches 80 to contact and close the fasteners in the media. Actuation mechanism 100 comprises motor 30, with belt or band 102 being driven by motor 30 and extending from motor 30 to closing assembly 25. Corners 103, e.g. in the form of pulleys, wheels, or other guide structure, guide belt 102 within the frame of fastening device 10 and/or within closing assembly 25. Belt 102 drives gear wheels 104, which are rigidly secured with respect to cams 105.

Figure 3:
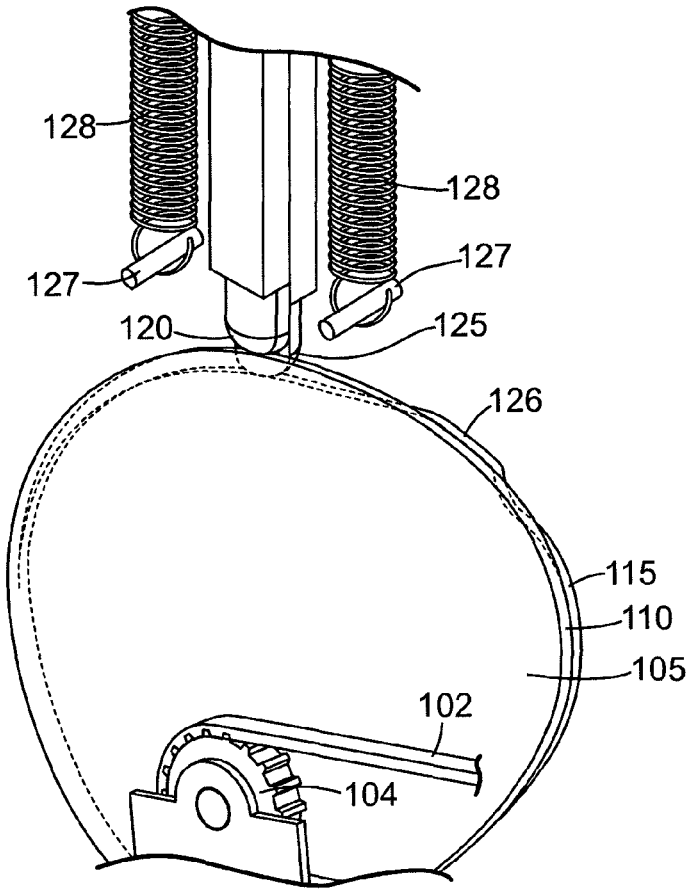
FIG. 3 is a perspective view of a portion of an actuation mechanism, according to an embodiment of the invention.

As shown in FIG. 3, each cam 105 defines two cam surfaces 110, 115. For purposes of description, a single cam 105 is considered shown in FIG. 3 and is considered to define both surfaces 110, 115. It should be appreciated, however, that cam 105 illustrated in FIG. 3 alternatively is considered to include two cams that are rigidly attached together, each defining a respective surface 110, 115. Each cam surface 110, 115 is adapted to engage and move one of two cam followers 120, 125. More specifically, cam surface 110 is adapted to drive cam follower 120 upon movement of cam 105 by motor 30. Cam follower 120 is rigidly connected to or otherwise operably connected to closing mechanism 27, including one or more fastener clinches 80 thereof. Cam follower 125 is rigidly connected to or otherwise operably connected to at least a portion of each active fastener clinch 80. Cam 105, and more specifically cam surface 115 thereof, defines outdented portion 126 to move cam follower 125, as will be described.

Bearing posts 127 are rigidly attached to closing assembly 25, and tension springs 128 are secured to bearing posts 127. Tension springs 128 are adapted to hold cam followers 120, 125 in contact with cam surfaces 110, 115. Ends of tension springs 128 opposite bearing posts 127 are fixedly attached to closing mechanism 27, e.g. to one or both of cam followers 120, 125, or structure that itself is fixedly attached to or supported with respect to cam followers 120, 125.

Figure 4:
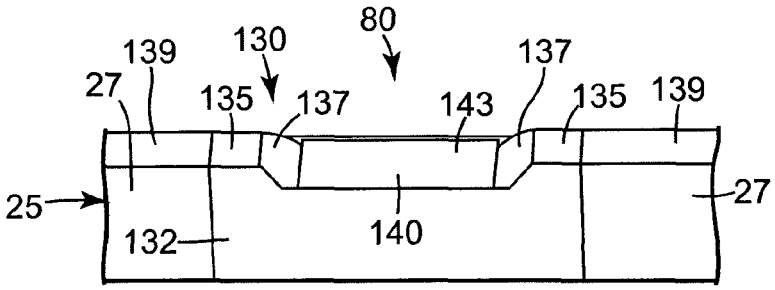
FIG. 4 is a perspective view of a fastener clinch in a first configuration, according to an embodiment of the invention.
Figure 5:
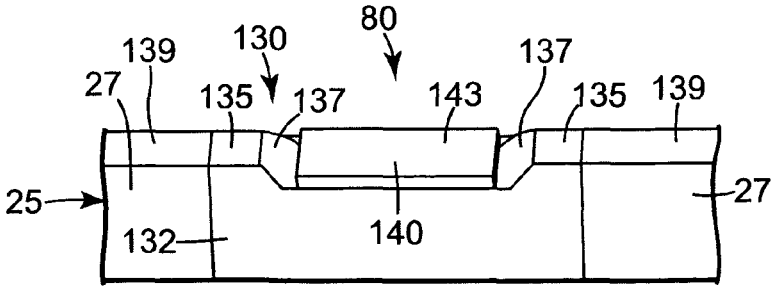
FIG. 5 is a perspective view of the FIG. 4 fastener clinch in a second configuration, according to an embodiment of the invention.

FIGS. 4–5 illustrate additional features of clinches 80 of closing assembly 25. Each clinch 80 is at least partially composed of saddle assembly 130. Saddle assembly 130 includes outer follower structure 132, also called a first saddle member or first member, which defines first generally flat surfaces 135 and second generally flat surfaces 137 extending at an angle to first surfaces 135. Each surface 135 is generally flush with corresponding surface 139 of closing mechanism 27 of closing assembly 25. Outer follower structure 132 is rigidly or operably coupled with and driven by first cam follower 120, as previously described, and optionally is one-piece therewith.

Saddle assembly 130 also includes inner follower structure 140, also called a second saddle member or second member, which defines generally flat surface 143 extending generally parallel with surfaces 135 and at an angle with respect to surfaces 137. Inner follower structure 140 is in a rest position in FIG. 4, but is moved from the rest position, upwardly as viewed in FIG. 4, to a clinch position in FIG. 5 in which the fastener is clinched. In the clinch position, surface 143 is above, generally flush with, or just below surfaces 135 and 139. Second saddle member or inner follower structure 140 is rigidly or operably coupled with and moved by second cam follower 125, and optionally is one-piece therewith. Second saddle member or inner follower structure 140 is disposed within first saddle member or outer follower structure 132.

Cam follower 120 is adapted to move fastener clinch 80, including both first member or outer follower structure 132 and second member or inner follower structure 140, toward a respective fastener held within fastener head 22. When cam follower 120 moves outer follower structure 132 toward fastener head 22 to discharge a fastener, the discharge causes ends of the fastener to pierce through the media and engage or approach angled surfaces 137. Outdented portion 126 of cam 105 is adapted to then move second cam follower 125 and inner follower structure 140 to an extended position relative to first cam follower 120 and outer follower structure 132, to close the respective fastener in the media. Such movement and closing occur when first cam follower 120 is itself in a highest or most extended position. More specifically, outdented portion 126 moves second cam follower 125 from the rest position of FIG. 4 to the clinching position of FIG. 5, raising surface 143 and causing surface 143 to contact the ends of the fastener and/or bend the ends of the fastener to a closed position.

Thus, movement of cam follower 120 causes fastener clinch 80, including both outer follower structure 132 and inner follower structure 140, to move simultaneously toward an associated fastener head 22. During such movement, media positioned on or supported by outer follower structure 132, or on the remainder of closing assembly 25, moves toward fastener heads 22. In the illustrated embodiment, such movement is movement in an upward direction. Engagement of fastener head 22 by the media moved by fastener clinch 80 and the surrounding structure automatically causes discharge of a fastener from fastener head 22. Movement of cam follower 125 then occurs, due to engagement with outdented portion 126, causing movement of inner follower structure 140 relative to outer follower structure 132. Cam surface 115 drives cam follower 125, in the direction of fastener head 22, to cause inner follower structure 140 to move upwardly from the position illustrated in FIG. 4 to the position illustrated in FIG. 5, to contact the ends of the discharged fastener and close the discharged fastener in the media.

Saddle assembly 130, when used in fastening sheets together, includes first saddle member or outer follower structure 132 as an example of means for applying force to release a staple or other fastener from staple dispenser or fastener head 22. Second saddle member or inner follower structure 140 is an example of means for clinching the fastener into a closed position, with the means for clinching 140 first moving simultaneously with and in the same direction as the means for applying 132 to both position sheets or other media and to apply the force to release the fastener from staple head or dispenser 22. Means for clinching 140 subsequently moves relative to means for applying 132 to clinch the fastener. Motor 30, first cam surface 110, first cam follower 120, second cam surface 115, and/or second cam follower 125 are an example of means for actuating both the means for applying 132 and the means for clinching 140. According to an alternative description, first cam surface 110 and first cam follower 120 are considered as part of the means for applying force 132, or as part of the first saddle member, and second cam surface 115 and second cam follower 125 as part of the means for clinching 140, or as part of the second saddle member. The means for actuating comprises a single motor 30, according to one embodiment.

Figure 6:
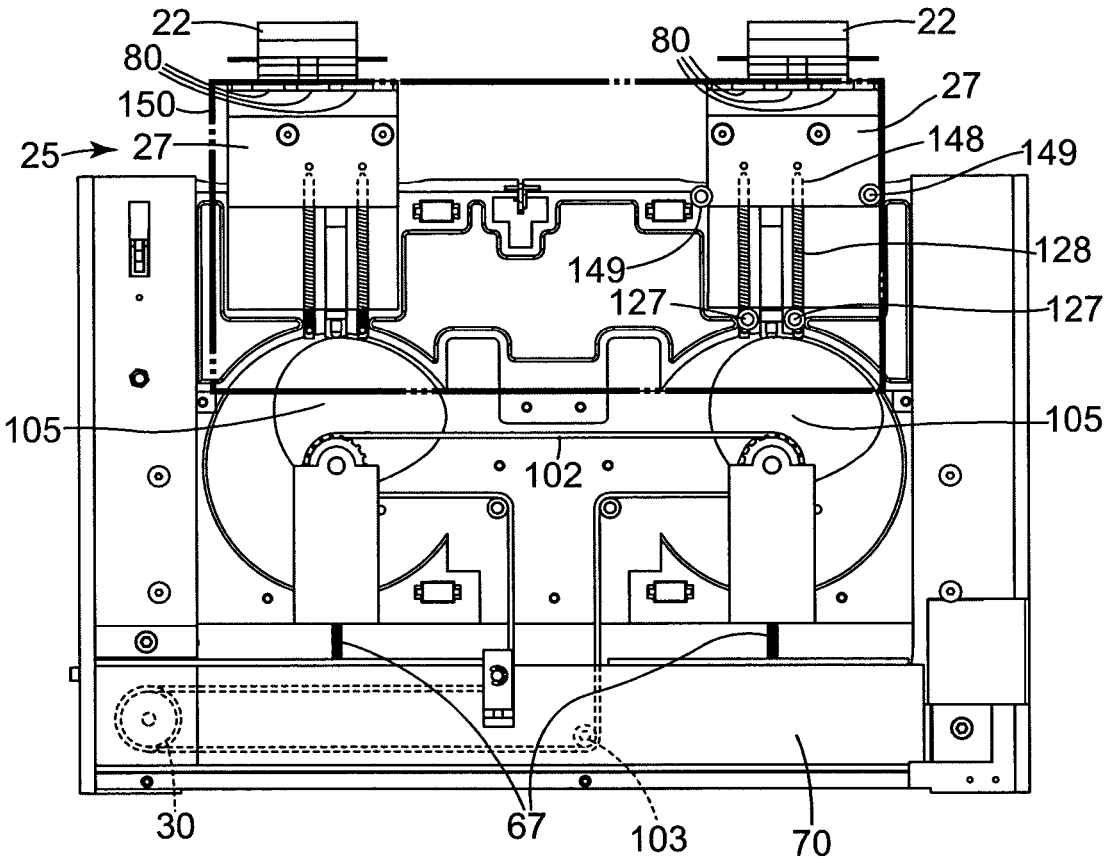
FIG. 6 is a side view of a portion of the FIG. 1 device with media, according to an embodiment of the invention.

FIG. 6 shows clinches 80 in their upwardly extended position, as moved by closing mechanisms 27. According to the illustrated embodiment, closing mechanisms 27 in their entireties move upwardly toward respective fastener heads 22. FIG. 6 also illustrates springs 128 in an extended configuration when closing mechanisms 27 are raised, to maintain contact between cams 105 and the cam followers, as described earlier herein. Ends 148 of springs 128 opposite bearing posts 127 are fixedly attached to closing mechanism 27. Additional bearing points 149 maintain alignment between each fastener head 22 and the followers 120, 125. FIG. 6 also shows media 150 positioned over closing assembly 25. Media 150 is positioned over closing assembly 25 such that a crease or central bend is created in media 150.

Figure 7:
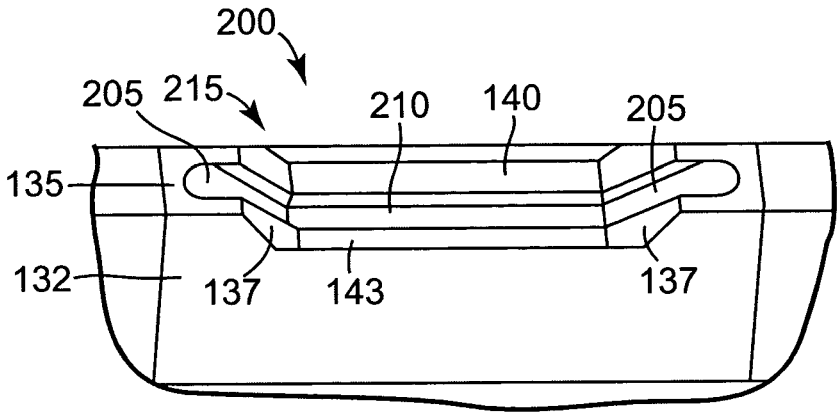
FIG. 7 is a perspective view of a fastener clinch in a first configuration, according to an embodiment of the invention.

FIG. 7 illustrates alternative fastener clinch 200, one or more of which are optionally included in previously described closing mechanism 27. Fastener clinch 200 includes certain features in common with fastener clinch 80 of FIG. 4, and to simplify the disclosure, descriptions of those features will not all be repeated. Like reference numerals are used to denote like or analogous elements. Fastener clinch 200 includes guides, grooves or channels 205, 210 for engaging ends of the fastener. More specifically, first member 132 of saddle assembly 215 defines recessed fastener guide or channel 205, and second member 140 defines recessed fastener guide or channel 210. Channel 210 is generally straight and generally continuous, and channel 205 is generally straight, generally discontinuous, and disposed on opposite ends of channel 210. Channel 210 is generally aligned with first member 132 to receive at least a portion of the fastener from channel 205. Channel 205 is generally aligned with opposite ends of channel 210, such that opposite ends of the fastener are guided or moved from channel 205 directly, and generally simultaneously, to channel 210. Additionally, first channel 205 is disposed at an angle to second channel 210, and e.g. to previously described surfaces 135, 143, to guide the ends of the media fastener to second channel 210. The angle between surface 137 and surface 143 is generally the same as that between channel 205 and channel 210. Channel 205 is recessed relative to surfaces 135 and 137, and channel 210 is recessed relative to surface 143.

Fastener clinch 200 of FIG. 7 is also similar to fastener clinch 80 of FIG. 4 in the manner it is actuated. To simplify the disclosure, details of the actuation will not all be repeated. Clinch 200 is operably coupled with previously described cam 105, cam surface 110, cam follower 120, and/or one or more portions of closing mechanism 27, for example, serving as structure adapted to move first member 132 and second member 140 simultaneously toward fastener head 22 for discharge of one or more fasteners. First member 132 at least partially supports and generally surrounds second member 140 for movement therewith. Cam 105, cam surface 115, cam follower 125, and/or one or more portions of closing mechanism 27, for example, constitute structure for moving second member 140 relative to first member 132.

Figure 8:
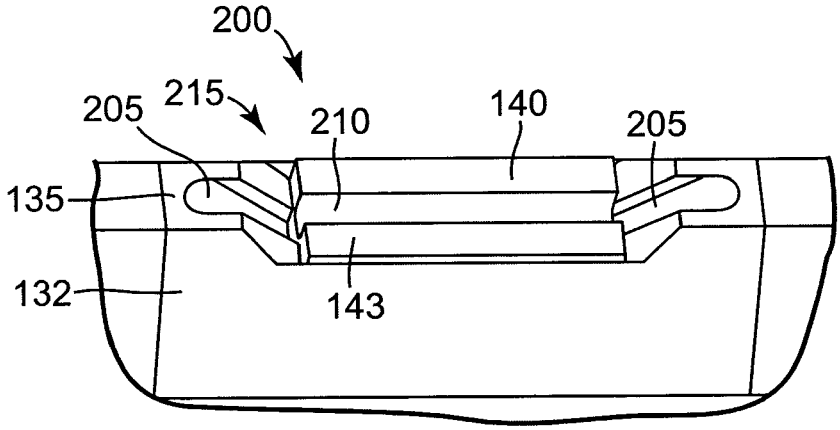
FIG. 8 is a perspective view of the FIG. 7 fastener clinch in a second configuration, according to an embodiment of the invention.

FIG. 8 shows member 140 in a raised or moved position with respect to member 132. Second channel 210 is adapted to move from a position generally aligned with first channel 205, as illustrated in e.g. FIG. 7, for receiving ends of the media fastener, to a position generally unaligned with first channel 205, as illustrated in FIG. 8, to close the media fastener or at least move the media fastener toward the closed position. Surface 143 is adapted to move toward or past surface 135.

Figure 9:
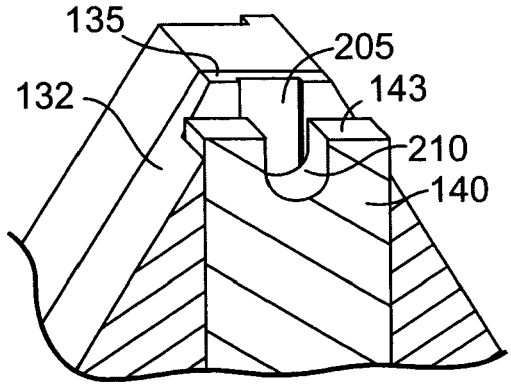
FIG. 9 is a perspective cross-sectional view of the FIG. 7 fastener clinch, according to an embodiment of the invention.

FIG. 9 is a perspective cross-sectional view of fastener clinch 200 with second member 140 in a raised or moved position.

Figure 10:
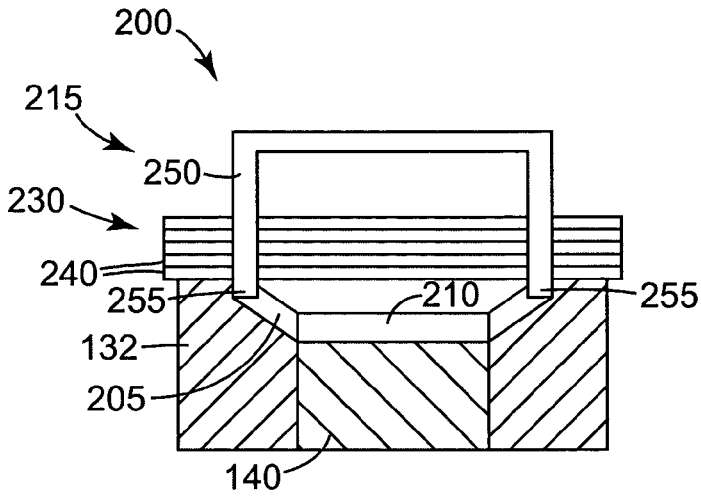
FIG. 10 is a cross-sectional view of a fastener clinch in an open configuration, according to an embodiment of the invention.

With reference to FIG. 10, fastener clinch 200 and/or saddle assembly 215 are, or are part of, a media-fastener closing device for receiving media 230 comprising individual media elements 240. The closing device comprises member 132 as a first receiver or closing member that defines channel 205 for receiving media fastener 250, and specifically a plurality of ends 255 of media fastener 250. In the case where fastener 250 is a staple, the plurality of ends 255 of fastener 250 include both ends of the staple. For purposes of illustration, fastener 250 is not necessarily drawn to scale. Member 140 is a second receiver or closing member defining second channel 210 for receiving the plurality of ends 255 of media fastener 250 from first channel 205. The previously described movement device, including cam 105 and/or cam follower 125, raises or moves second receiver 140 and second channel 210 relative to first receiver 132 to close media fastener 250. Second channel 210 extends in a generally straight direction of movement of the media-fastener ends 255 in second channel 210, e.g. in the left-right direction as viewed in FIG. 10.

A method of closing fastener 250 includes engaging ends 255 of fastener 250 with first groove 205 of first closing member 132, as illustrated in FIG. 10. The engaging with first closing member 132 comprises moving both first closing member 132 and second closing member 140 toward a fastener-dispensing location, for example by movement of cam follower 120 as driven by cam 105.

Figure 11:
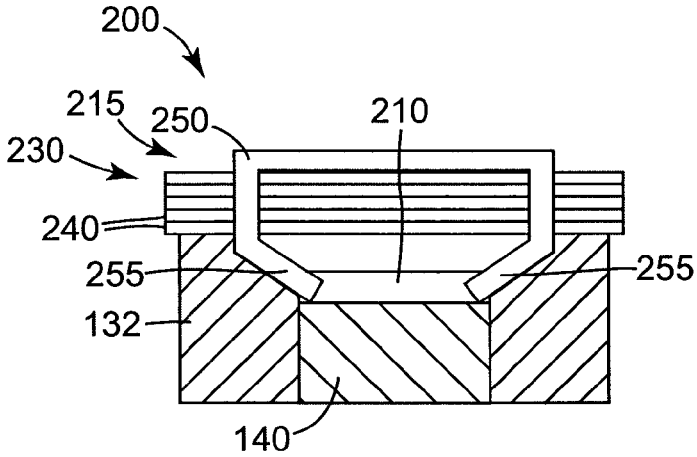
FIG. 11 is a cross-sectional view of a fastener clinch in a partially closed configuration, according to an embodiment of the invention.

With reference to FIG. 11, the method also includes bending ends 255 of fastener 250 with first closing member 132, and engaging ends 255 of fastener 250 with second groove 210 of second closing member 140. The engaging with second closing member 140 comprises receiving ends 255 of fastener 250 from first groove 205 into second groove 210 defined in second closing member 140. Second closing member 140 is supported by first closing member 132 for movement therewith and is movable relative to first closing member 132, as previously described.

Figure 12:
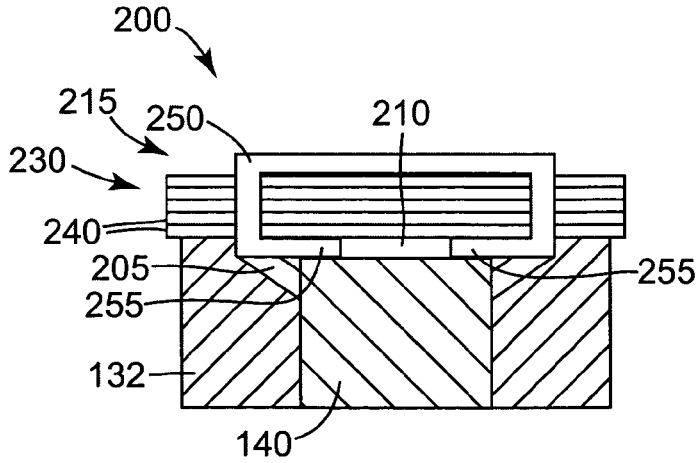
FIG. 12 is a cross-sectional view of a fastener clinch in a closed configuration, according to an embodiment of the invention.

With reference to FIG. 12, the method also includes bending ends 255 of fastener 250 with second closing member 140 to close fastener 250. The bending with second closing member 140 comprises moving second closing member 140 relative to first closing member 132 to an extended or uppermost position, as previously described.

According to embodiments of the invention, channel or guide 205 is at least a portion of means for receiving and guiding ends 255 of fastener 250 within first member or mover 132, and channel or guide 210 as at least a portion of means for receiving and guiding ends 255 of fastener 250 within second member or mover 140 operably coupled with first mover 132. The means for receiving and guiding ends 255 of fastener 250 within first mover 132 is disposed on opposite sides of the means for receiving and guiding ends 255 of fastener 250 within second mover 140. Cam 105 and/or cam followers 120, 125 serve as at least a portion of means for moving both of the means for receiving and guiding simultaneously, and for moving them independently.

Figure 13:
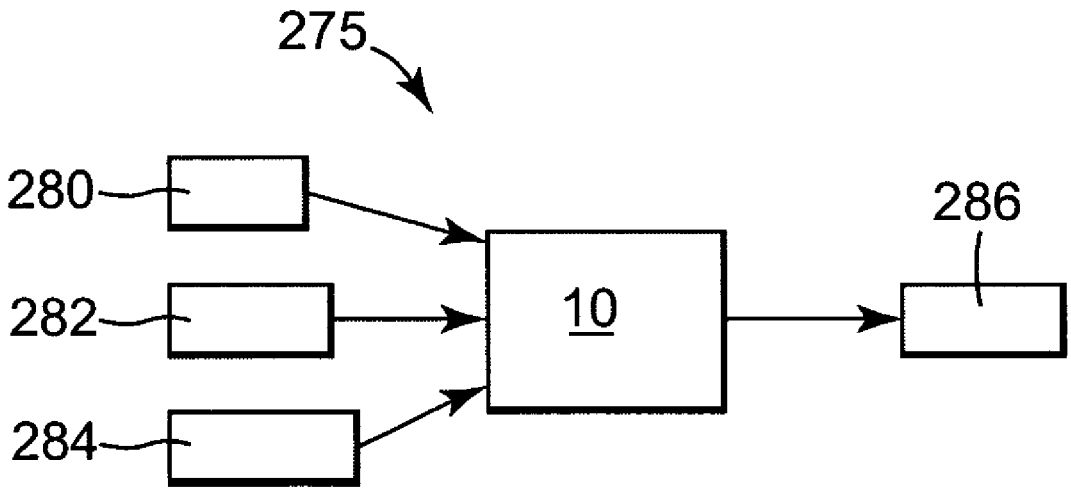
FIG. 13 shows a media fastening system, according to an embodiment of the invention.

FIG. 13 schematically illustrates media fastening system 275. System 275 optionally includes one or more of printer or printing output 280, photocopier or photocopying output 282, and facsimile device or other media output 284, for supplying media to fastening device 10 described herein. Fastening device 10 then optionally supplies fastened media to fastening-device output 286, where further processing optionally occurs, for example binding, boxing, punching, trimming, or other processing.

Embodiments of the invention provide a number of advantages. Channels or guides 205, 210 accurately and precisely guide ends 255 of fastener 250, bending fastener 250 from the open configuration of FIG. 10, through the partially closed configuration of FIG. 11, to the closed configuration of FIG. 12. Multiple fasteners 250 are applied to media 150, 230 and then clinched, all generally simultaneously, in a relatively compact space and with relatively few moving parts, in a relatively short amount of time. Besides speed, simplicity and compactness, the fastening, fastener-clinching, and/or transporting or guiding of media 150, 230 all occur based on actuation of a single motor 30. An additional motor 40 moves fastener heads 22 to multiple positions based on e.g. the size of the media to be fastened, but the acts of discharging fasteners 250 from fastener head 22 and closing them are accomplished by movement of closing assembly 25 as driven by single motor 30, once motor 40 has driven fastener heads 22 to a desired location. Fastener heads 22 optionally are commercial, off-the-shelf or specialized staple heads or other fastener discharging devices. Additionally, embodiments of the invention do not require complex software or firmware to actuate and monitor the various components of fastening device 10 to discharge fasteners 250, thereby reducing operational complexity.

The term "media" as used herein should be considered to include a single sheet or other element of media, and/or a stack of media, for example. The term "stack" as used herein should be considered to include two or more sheets or other elements of media in a generally or partially overlying configuration, for example. Media according to embodiments of the invention includes not only paper, but also cloth or other fabric, plastic, or any other material that is capable of fastening by staples or other fasteners. Such media also optionally includes sheets, pages, covers, transparencies, or other elements of a book, booklet, folder or other fastened stack. A wide variety of fasteners are also contemplated according to embodiments of the invention, in addition to staples.

Although specific embodiments have been illustrated and described herein, it will be appreciated by those of ordinary skill in the art that a wide variety of alternate and/or equivalent implementations calculated to achieve the same purposes are optionally substituted for the specific embodiments shown and described without departing from the scope of the present invention. Embodiments of the invention, for example, are useable with a wide variety of external devices such as printers, copiers, facsimile machines, and other output devices or other devices. A wide variety of materials is contemplated for use for the various disclosed structural components, e.g. steel of sufficient hardness, DELRIN acetyl resin, ABS plastic, and other materials. Each cam 105, for example, is constructed of a material of sufficient hardness to withstand an effectively unlimited number of repetitive movements, e.g. one million rotations or more, for example H-13 steel of Rockwell Hardness (HRC) 49–51. Directional terminology, such as up, down, left, right, over, under, above, below, etc. is used for purposes of illustration and description only, and is not intended necessarily to be limiting. Those with skill in the chemical, mechanical, electro-mechanical, electrical, and computer arts will readily appreciate that the present invention may be implemented in a very wide variety of embodiments. This application is intended to cover any adaptations or variations of the embodiments discussed herein.

What is claimed is:

1. Apparatus for closing a fastener, the apparatus comprising:

a first member adapted to engage and bend a fastener toward a closed position;

a second member defining a recessed fastener guide adapted to engage and bend the fastener toward the closed position, the recessed fastener guide being generally aligned with the first member to receive at least a portion of the fastener from the first member;

structure for moving the first member; and structure for moving the second member relative to the first member to move the fastener toward the closed position, wherein the structure for moving the first member is adapted to move the first member and the second member simultaneously, and wherein the first member at least partially supports the second member for movement therewith.

2. The apparatus of claim 1, wherein the structure for moving the first member and the structure for moving the second member comprise at least one cam defining two cam surfaces.

3. The apparatus of claim 2, wherein the structure for moving the first member and the structure for moving the second member comprise cam followers adapted to engage the two cam surfaces.

4. The apparatus of claim 1, wherein the recessed fastener guide comprises a groove defined in the second member.

5. The apparatus of claim 1, wherein the first member defines a recessed fastener guide; further wherein the recessed fastener guide of the first member is generally aligned with opposite ends of the recessed fastener guide of the second member to guide opposite ends of the fastener to the recessed fastener guide of the second member.

6. The apparatus of claim 1, wherein the recessed fastener guide of the second member defines a generally straight, generally continuous channel adapted to receive both ends of the fastener.

7. A media-fastener closing device, comprising:

a first receiver defining a first channel for receiving a plurality of ends of a media fastener:

a second receiver defining a second channel for receiving the plurality of ends of the media fastener from the first channel; and a movement device for moving the second receiver, and the second channel, relative to the first receiver to close the media fastener, wherein the first receiver comprises a first surface and the first channel is recessed relative to the first surface; further wherein the second receiver comprises a second surface, and the second channel is recessed relative to the second surface, and wherein the movement device is adapted to move the second surface past the first surface to close the media fastener.

8. The closing device of claim 7, wherein the second channel extends in a generally straight direction of movement of the media-fastener ends in the second channel.

9. The closing device of claim 7, wherein the movement device is adapted to move the second channel from a position generally aligned with the first channel, for receiving the ends of the media fastener, to a position generally unaligned with the first channel, to close the media fastener.

10. The closing device of claim 7, wherein the first receiver generally surrounds the second receiver.

11. The closing device of claim 7, wherein the second channel is a generally continuous channel; further wherein the first channel is a generally discontinuous channel disposed on opposite ends of the second channel.

12. The closing device of claim 7, wherein the first channel is disposed at an angle to the second channel to guide the ends of the media fastener to the second channel.

13. A method of closing a fastener, comprising:

engaging ends of the fastener with a first groove of a first closing member:

bending the ends of the fastener with the first dosing member;

engaging the ends of the fastener with a second groove of a second closing member, the second closing member being supported by the first closing member for movement therewith and being movable relative to the first closing member; and bending the ends of the fastener with the second closing member to close the fastener.

14. The method of claim 13 wherein the engaging with the first closing member comprises moving both the first closing member and the second closing member toward a fastener-dispensing location.

15. The method of claim 13, wherein the engaging with the first cLosing member comprises engaging the ends of the fastener in the first groove in the first closing member; further wherein the engaging with the second closing member comprises receiving the ends of the fastener from the first groove into the second groove in the second closing member.

16. The method of claim 15, wherein the bending with the second closing member comprises moving the second closing member relative to the first closing member.

* * * * *

UNITED STATES PATENT AND TRADEMARK OFFICE

CERTIFICATE OF CORRECTION

PATENT NO. : 7,111,378 B2
APPLICATION NO. : 10/644300
DATED : September 26, 2006
INVENTOR(S) : Francisc Javier Ramirez Aldana It is certified that error appears in the above-identified patent and that said Letters Patent is hereby corrected as shown below:

In column 9, line 30, in Claim 7, delete "fastener:" and insert -- fastener; --, therefor.

In column 10, line 19, in Claim 13, delete "member:" and insert -- member; --, therefor.

In column 10, line 20, in Claim 13, delete "dosing" and insert -- closing --, therefor.

In column 10, line 29, in Claim 14, after "claim 13" insert -- , --, therefor.

In column 10, line 35, in Claim 15, delete "cLosing" and insert -- closing --, therefor.

Signed and Sealed this

Eleventh Day of August, 2009

David J. Kappos

David J. Kappos
*Director of the United States Patent and Trademark Office*